US005312104A

United States Patent [19]

Miller

[11] Patent Number: 5,312,104

[45] Date of Patent: * May 17, 1994

[54] CARD READER FOR BLACKJACK TABLE

[75] Inventor: Arthur C. Miller, Las Vegas, Nev.

[73] Assignee: Tech Art, Inc., Las Vegas, Nev.

[ * ] Notice: The portion of the term of this patent subsequent to Aug. 13, 2008 has been disclaimed.

[21] Appl. No.: 709,363

[22] Filed: May 31, 1991

Related U.S. Application Data

[63] Continuation-in-part of Ser. No. 446,205, Dec. 4, 1989, Pat. No. 5,039,102.

[51] Int. Cl.[5] ..... A63F 1/06

[52] U.S. Cl. ..... 273/148 R; 273/148 A; 273/296; 273/304; 273/309

[58] Field of Search ..... 273/148 R, 148 A, 149 R, 273/149 P, 138 R, 138 A, 85 CP, 292, 293, 296, 303, 304, 305, 309; 108/23

[56] References Cited

U.S. PATENT DOCUMENTS

| | | | |
|---|---|---|---|
| D. 317,951 | 7/1991 | Miller | D21/57 |
| 1,590,463 | 6/1926 | Wood . | |
| 1,919,922 | 7/1933 | Baker, Jr. et al. . | |
| 2,046,595 | 7/1936 | Yerkes | 273/136 |
| 3,034,512 | 5/1962 | Hunter | 129/16.1 |
| 3,165,319 | 1/1965 | Benima | 273/149 |
| 3,222,071 | 12/1965 | Lang | 273/149 |
| 3,312,473 | 4/1967 | Friedman et al. | 273/149 |
| 3,489,907 | 1/1970 | Kenez | 250/219 |
| 3,529,829 | 9/1970 | Seifert | 273/149 |
| 3,658,342 | 4/1972 | Boren | 273/149 P |
| 3,690,670 | 9/1972 | Cassady et al. | 273/149 P |
| 3,716,238 | 2/1973 | Porter | 273/149 P |
| 3,731,936 | 5/1973 | Copeland | 273/149 P |
| 3,742,616 | 7/1973 | Heller | 35/8 |
| 3,743,294 | 7/1973 | Forster | 273/149 P |
| 3,751,041 | 8/1973 | Seifert | 273/149 P |
| 3,779,554 | 12/1973 | Brix | 273/131 B |
| 3,814,436 | 6/1974 | Boren | 273/149 P |
| 3,858,797 | 1/1975 | Takeuchi | 235/61.11 R |
| 4,146,229 | 3/1979 | Morse | 273/150 |
| 4,314,700 | 2/1982 | Dylag | 273/148 R |
| 4,534,562 | 8/1985 | Cuff et al. | 273/149 P |
| 4,822,050 | 4/1989 | Normand et al. | 273/149 R |
| 5,039,102 | 8/1991 | Miller | 273/148 R |
| 5,067,713 | 11/1991 | Soules et al. | 273/149 P |
| 5,110,134 | 5/1992 | Laughlin et al. | 273/293 |
| 5,219,172 | 6/1993 | Laughlin et al. | 273/148 R |
| 5,224,712 | 7/1993 | Laughlin et al. | 273/148 R |

FOREIGN PATENT DOCUMENTS

| | | | |
|---|---|---|---|
| 0310516 | 4/1989 | European Pat. Off. | A63F 1/14 |
| 1039429 | 9/1958 | Fed. Rep. of Germany | A63F 9/06 |
| 3807127 | 9/1989 | Fed. Rep. of Germany | A63F 1/18 |
| 2109213 | 5/1972 | France | A63F 1/00 |
| 2186839 | 1/1974 | France | A63F 1/00 |
| 2427107 | 12/1979 | France | A63F 1/06 |
| 2576518 | 8/1986 | France | A63F 1/14 |

*Primary Examiner*—Jessica J. Harrison

*Attorney, Agent, or Firm*—Malin, Haley, DiMaggio & Crosby

[57] ABSTRACT

A device for speeding the pace of a game of blackjack is provided. The device is comprised of a housing having a top surface and an upper planar portion. The top surface will be connected on top to the upper planar portion. A card reader for reading a corner of a specialized playing card is located within the housing. An indicator cooperating with the card reader is provided to inform the dealer if his down card is of a desired value. There is also disclosed herein a method for increasing the speed of play in an organized game of blackjack.

33 Claims, 6 Drawing Sheets

CARD READER FOR BLACKJACK TABLE

This application is a continuation-in-part of copending application Ser. No. 07/446,205, filed Dec. 4, 1989, now U.S. Pat. No. 5,039,102, issued Aug. 13, 1991.

BACKGROUND OF THE INVENTION

1. Field of the Invention

The instant invention relates to an apparatus for reading playing cards and more particularly relates to a device for reading a corner of a playing card while the playing card is face down on a gaming table.

2. Description of the Prior Art

The business of a modern gambling casino requires careful attention to efficiency and accuracy to enhance the fairness of play and the profitability of the various tables. Not only is the speed of play deemed critical by the individual casinos, but most players prefer, and in fact demand, a rapid pace of play. Further, the element of fairness is of utmost importance to both casino owner and player alike.

In the game of blackjack, a time consuming delay arises when the dealer's up card, that is his exposed card, has a value of ten, and his down card is an Ace. Another time consuming delay occurs when the dealer's up card is an Ace, and his down card has a value of ten. In either case the dealer will first play out the hand with the players at the table and, after dealing the last player, will expose his down card. If his down card is an Ace and his face up card has a value of ten or if his down card has a value of ten and his face-up card is an Ace, the dealer has twenty-one and automatically wins. When this condition is present, the time spent dealing to players is essentially wasted. If the value of the down card held by the dealer could have been ascertained without breaching the necessary level of security at the table, the time consumed in dealing out to the remaining players after the dealer had earlier obtained twenty-one could have been avoided and a new hand commenced. Throughout the course of play, the unnecessary delays resulting from this occurrence accumulate to a substantial amount of time, which can be avoided if it can be determined early when the dealer is dealt twenty-one.

However, because casinos now forbid dealers to look at their down cards during a game of twenty-one for security reasons, dealers presently have no way of determining if they have twenty-one until all players have played out the hand. That is, the exposure of any card not intended to be seen by anyone but the dealer imposes a risk to the security of the hand. Further, a dealer, if so inclined, can easily cheat by looking at his down card and providing a sereptious signal to a cohort player.

When weighed in light of the desirability of ascertaining whether the dealer has blackjack when his or her up card is an Ace or has the value of ten, some means are required to speed up play in a manner that is both fair to the players and of low risk to the casino. The inventor is not aware of any devices currently available which address the aforementioned problem except as disclosed in copending U.S. patent application Ser. No. 07/446,205, filed Dec. 4, 1989, now issued as U.S. Pat. No. 5,039,102 on Aug. 13, 1991.

SUMMARY OF THE INVENTION

The instant invention is intended to cure the above-mentioned shortcomings in the art. The invention is comprised generally of a card reading means for electronically or visually reading a portion of a playing card placed thereover, and an appropriate means for indicating the presence of certain values of cards in association with said means for reading. Preferably, the means for reading is connected to a planar top panel which in turn is connected to a housing for the invention. The planar top panel is adapted to be disposed in coplanar relationship with the playing surface of the blackjack table.

In a first embodiment the instant invention is comprised of a card reading device, for electronically sensing or reading, a portion of playing cards placed thereover, an energy source and an indicating device associated with a housing. The energy source is used to energize the indicating device when the dealer has obtained blackjack. The housing includes a smooth top panel, coplanar with the top surface of the table, for placing a playing card face down thereon to be read. A card receiving device may be attached to the top panel for receiving a corner of the card to be read. The card reading device senses the presence of certain value cards and ignores others and sends an indicating signal to the indicating device.

In a second embodiment a light source replaces the energy source of the first embodiment and apparatus for visually reading a portion of playing cards passed thereover are substituted for the device for electronically reading cards. The top panel is provided with an aperture disposed generally below and partially covered by the card receiving device and aligned generally vertically above the card reading device.

The instant invention will be used in conjunction with a deck of cards having a unique marking system. In a typical deck of playing cards, indicia (e.g. 5, 7, Q, A) are disposed in only the upper left hand and lower right hand corners. In the specialty deck contemplated for use with the instant invention the upper left hand indicia on each card is lowered down the left side of the playing card away from the upper left hand corner. In addition, the indicia is raised up the right side of each playing card away from the lower right hand corner. Also in the specialty deck, additional indicia to be read by the reading device is disposed on only the Ace cards in the upper right and lower left hand corners. Finally, a marking or other readable media is disposed on the upper left hand and lower right hand corners of all cards having a value of ten.

In operation, if the dealer's up card has a value of ten, he will place his down card face down on the top panel of the instant invention and then insert either the upper right or lower left hand corner of his down card, when viewed from the perspective of the playing face of the card, into the card receiving device to be read by the card reading device. If the inserted card is an Ace, the indicating device will so inform the dealer and it will become immediately known, before playing out the remainder of hand with the players at the table, that the dealer has won. Alternatively, if the dealer's up card is an Ace, he will place his down card face down on the top surface and then insert either the upper left or lower right hand corner of his down card, when viewed from the perspective of the playing face of the card, into the card receiving device to be read by the card reading device. If the inserted card has a value of ten, the indicating device will indicate that the dealer has won.

A further aspect of the invention lays in the method for increasing the speed of play of the game of blackjack in a fair and secure manner comprising the steps of dealing a hand of blackjack to a plurality of players, including the dealer, and if the dealer's upfacing card has a value of ten or is an Ace, ascertaining whether the dealer's down card is an Ace or has a value of ten, and if said down card is an Ace or a ten value card, terminating the hand or, alternatively, if said down card is other than an Ace or ten value card, continuing to play.

It is a principal object of the instant invention to provide an apparatus for reading indicia or other readable media from a portion of playing card in a game of blackjack.

It is also an object of the present invention to provide an apparatus and method for speeding up the play in organized blackjack in a fair and secure manner.

It is a further object of the present invention to provide a method of reading specialized indicia or other readable media from a playing card in a game of blackjack.

Having thus described the instant invention, particular reference will now be made to the detailed description of the invention where like elements are referred to by like numerals.

DETAILED DESCRIPTION OF THE PREFERRED EMBODIMENT

Figure 1A:
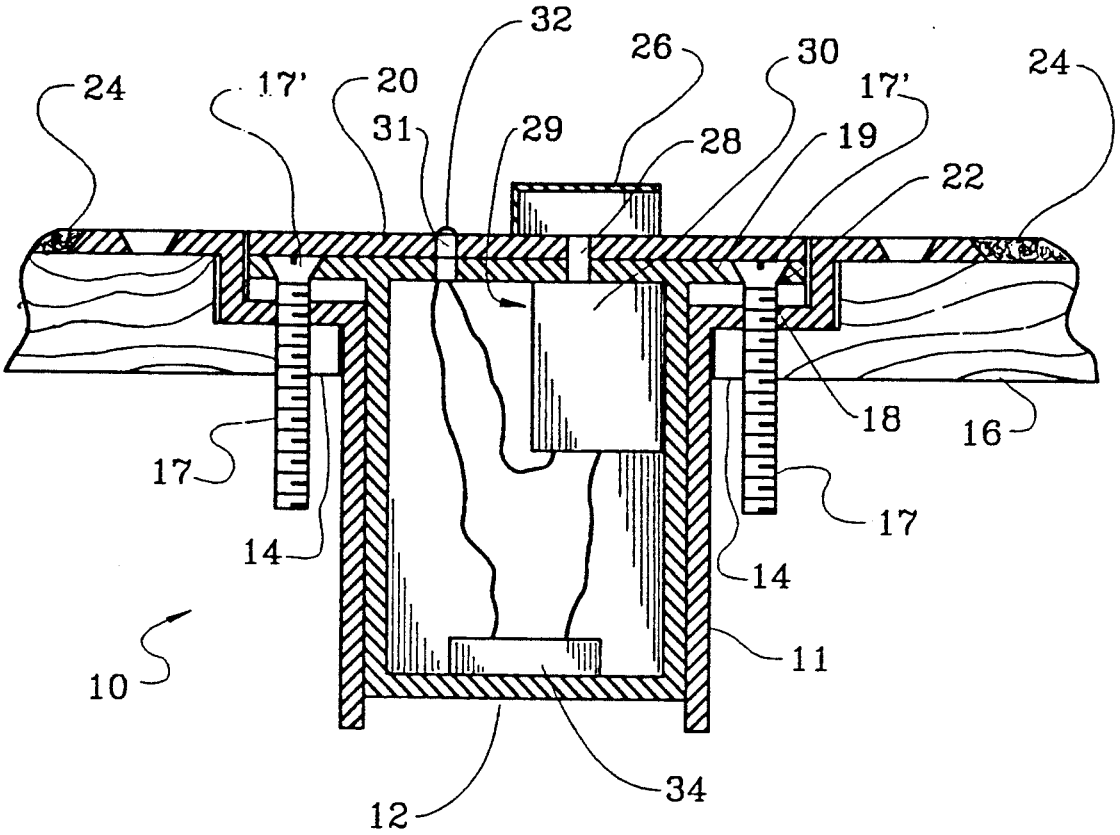
FIG. 1A shows a sectional view of a first embodiment of the instant invention mounted to a blackjack table.

Referring now to the drawings, FIG. 1A shows the instant invention generally designated by the reference numeral 10 comprised of a housing 12 adapted to be connected in a recess 14 of a case 11 by conventional attachment means, such as by threaded bolts 17 passed through apertures 18 of recess 14. Case 11 is adapted to be connected to a conventional blackjack casino table 16 by conventional attachment means (not shown), such as by countersunk screws (not shown) passed through apertures 13 defined by the horizontal upper surface of case 11. Housing 12 is comprised generally of a hollow rectangular member which may be integrally connected to an upper planar member 19. Member 19 is adapted to receive a top surface panel 20 connected to upper planar member 19 in coplanar association. A card receiving device 26 is connected to panel 20.

As it is preferred that top panel 20 form a smooth continuous surface with the top surface material 24 of blackjack table 16 so as not to mar any of the playing cards which will come into contact therewith, the connection of top panel 20 with member 19 should be concealed. To this end, threaded bolts 17 are passed through apertures 22 in member 19 and downwardly through corresponding apertures 18 defined by recess 14 of case 11. Top panel 20 may then be laminated to member 19 to conceal the heads 17' of bolts 17. The invention 10 disclosed herein is intended to fit in generally coplanar arrangement with the covering material 24 of conventional blackjack table 16.

As seen in FIG. 1A, a means for reading a portion of a playing card comprising a card reading device, generally designated by the reference numeral 29, will include sensor 30 and sensor lens 28. Sensor 30 may be either magnetic or optic. An indicator light 32 associated with panel 20, through aperture 31, along with a power source 34, is connected in series with sensor 30. Alternatively, an electronic bar code scanner receiver and decoder may be substituted for sensor 30 and sensor lens 28. Further in the alternative, an electronic circuit breaker/receiver and circuit element source may be utilized as the card reading device 29. If the dealer's down card is of a predetermined value, for example an ace where the dealer's up card is a ten value card, the insertion of a corner of the down card will break the circuit. This break in circuit will close a switch (not shown) which will in turn supply power to indicator light 32. Power source 34 may be a battery located inside housing 12 or may be an external power source fed through an opening (not shown) in the bottom of housing 12.

Figure 2A:
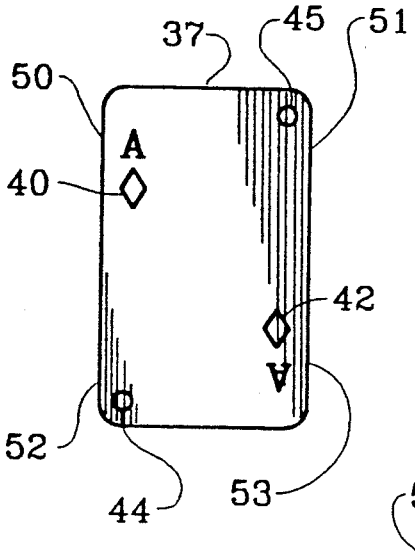
FIG. 2A shows the face side of an Ace card contemplated for use with the instant invention.
Figure 2C:
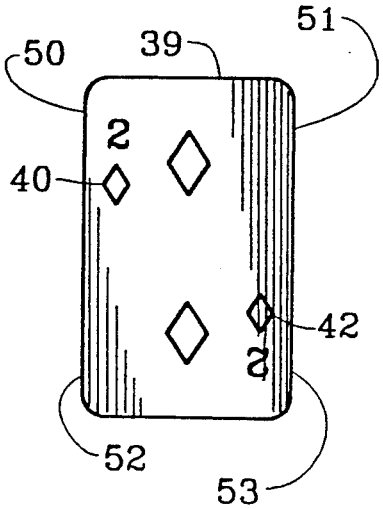
FIG. 2C shows the face side of a representative playing card other than an Ace card or ten value card contemplated for use with the instant invention.
Figure 2B:
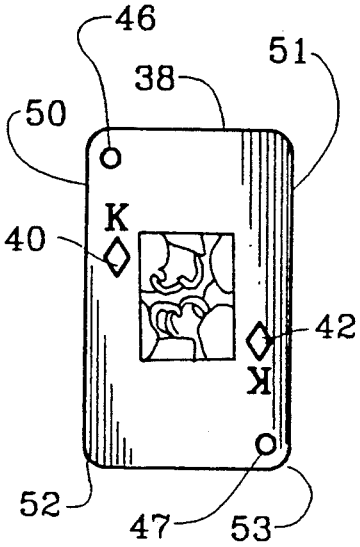
FIG. 2B shows the face side of a representative ten value card contemplated for use with the instant invention.
Figure 6:
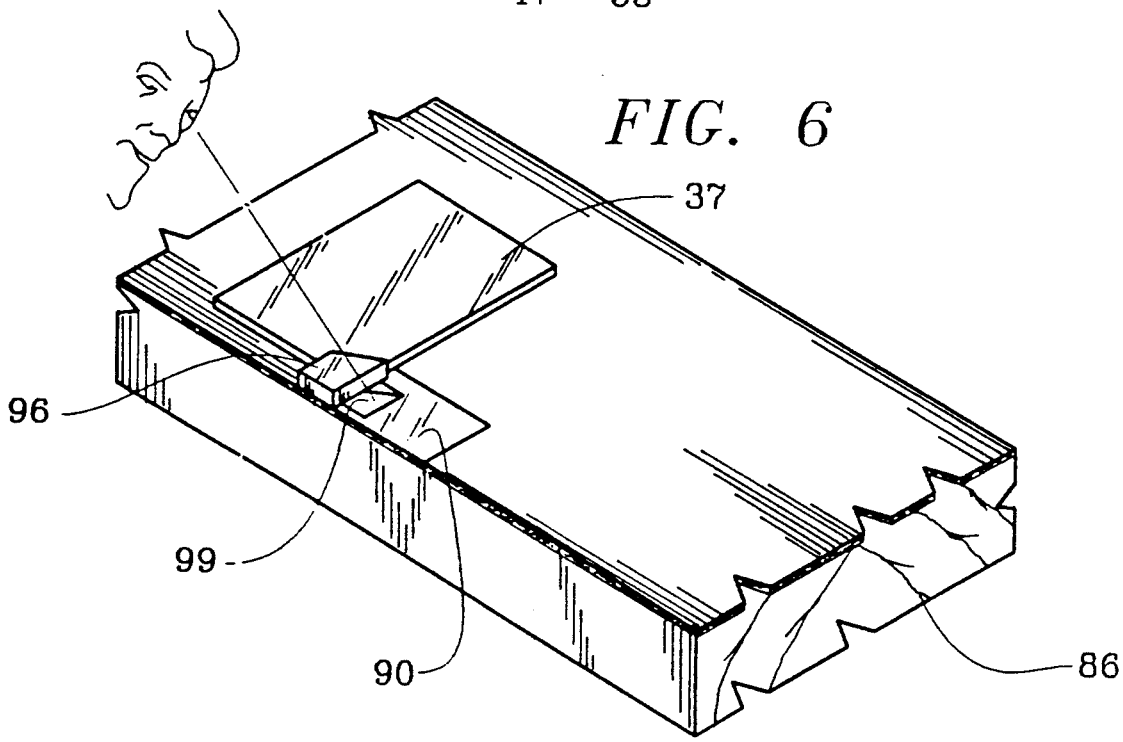
FIG. 6 shows the second embodiment of the instant invention being used to read a face down playing card on a typical blackjack table.

An ace card 37, ten value card 38 and a card other than an ace or ten value are shown in FIGS. 2A, 2B and 2C respectively. In the special deck of cards contemplated to be used with the instant invention, all 52 cards will be of one of the type of cards shown in FIGS. 2A, 2B, and 2C. As seen in FIGS. 2A, 2B and 2C, left hand indicia 40 has been lowered down the left side of cards 37, 38 and 39 and away from upper left hand corner 50. In addition, right hand indicia 42 has been raised up the right side of cards 37, 38 and 39 and away from lower right hand corner 53. As shown in FIG. 2A, ace card 37, as well as the remaining ace cards (A-hearts, A-clover, A-spade not shown) will have an additional indicia 44 and 45 in their lower left hand corner 52 and upper right hand corner 51, respectively. Indicia 44 and 45 will not be present on any of the remaining cards in the special deck. As shown in FIG. 2B, ten value card 38 as well as the remaining ten value cards (not shown) will have an additional indicia 46 and 47 in their upper left hand corner 50 and lower right hand corner 53 respectively. Indicia 46 and 47 will not be present on any of the remaining cards in the special deck. FIG. 2C shows a card 39 which represents any card in the special deck other than an ace or a ten value card. As seen in FIG. 2C, no indicia are present in any corner of card 39.

The embodiment used for card reading device 29 dictates the type of material used for items 44, 45, 46 and 47. When a magnetic sensor is used items 44, 45, 46 and 47 will be partially or totally ferromagnetic material. When an optic sensor is utilized items 44, 45, 46 and 47 will be made out of dark ink. When a bar code and decoder are used items 44, 45, 46 and 47 can be a single bar or a plurality of bars.

Figure 1B:
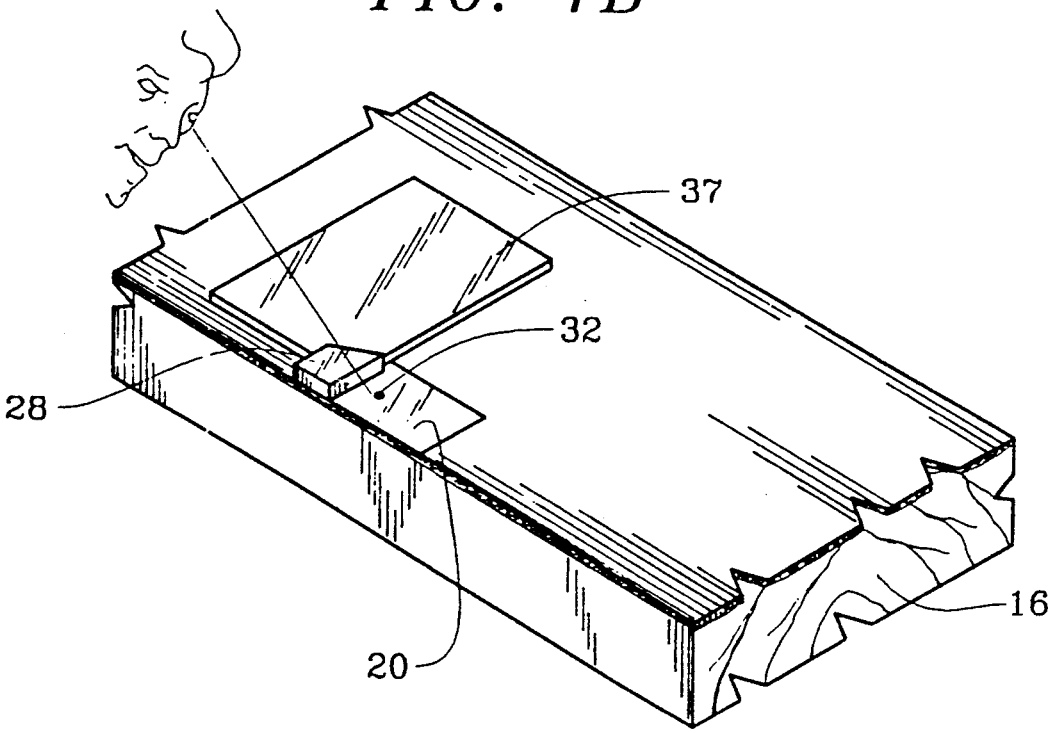
FIGS. 1B and 1C are perspective views of the first embodiment of the invention in use searching for a 10 value card and an Ace value card, respectively.

In operation, if the dealer's up card has a value of ten, the dealer will like to know if his down card is an ace. Therefore, he will place his down card face down on top surface 20 and then insert either the upper right hand corner 51 or lower left hand corner 52 of his down card, when viewed from the perspective of the playing face of the card, into card receiving means 26, as shown in FIG. 1B. Card receiving means 26 is connected to top surface 20 at a position which allows the inserted corner of the down card to be read by sensor 30 to determine if the down card is an ace.

As seen in FIG. 1A, the card receiving device 26 is a hood. However, card receiving device 26 is not limited to a hood and can be of any device which will position the face of the inserted corner over a sensor 30. The hood may have two vertical side walls. If the down card is an ace (such as card 37 in FIG. 2A), either marking 44 or 45 will be read, depending on whether upper right hand corner 51 or lower left hand corner 52 of the card, when viewed from the perspective of the playing face of the card, is inserted into card receiving means 26. Once marking 44 or 45 is read a closed circuit will be established between sensor or bar code/receiver 30, indicator light 32 and power source 34, thus allowing power source 34 to turn on light 32. Once light 32 has been turned on, the dealer will know that his down card is an ace and that he has "21" and has automatically won. Therefore, the hand does not have to continue on. Once the down card has been removed from card receiving means 26, the circuit will once again be open, thereby preventing power source 34 from energizing light 32. Accordingly, light 32 is normally off. Additionally, had the down card not been an ace, then no marking would have been read and light 32 would never have been turned on. If light 32 does not go on the game will continue on.

Figure 1C:
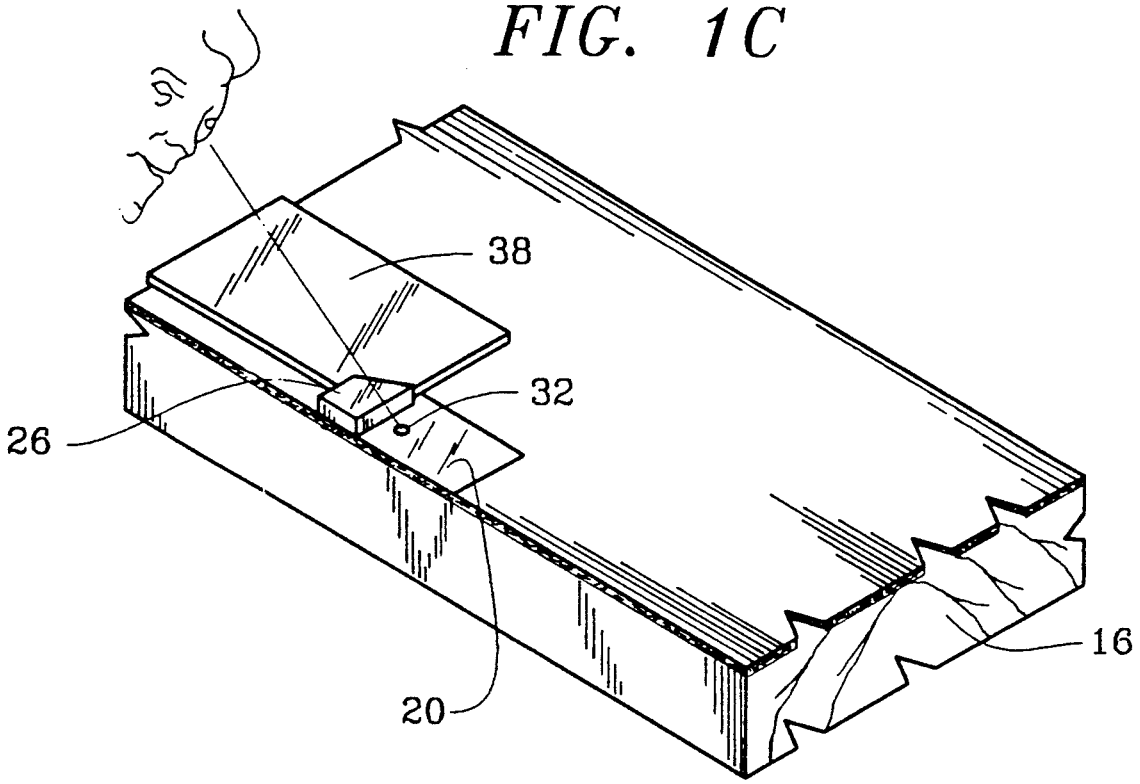

Alternatively, if the dealer's up card is an ace, he will want to know if his down card has a value of ten (e.g. 10, J, Q, K). Therefore, he will place his down card face down on top surface 20 and then insert either the upper left hand corner 50 or lower right hand corner 53 of his down card, when viewed from the perspective of the playing face of the card, into card receiving means 26, as shown in FIG. 1C. If the down card has a value of ten (such as card 38 of FIG. 2B) either item 46 or 47 will be read, depending on whether upper left hand corner 50 or lower right hand corner 53 was inserted into card receiving means 26. Once item 46 or 47 is read a closed circuit will be established as described above for items 44 or 45. Thus indicator light 32 will be energized and the dealer will know that his down card has a value of ten and that he has "21". Had the down card not had a value of ten, light 32 would not be turned on and the game would continue on.

Figure 3:
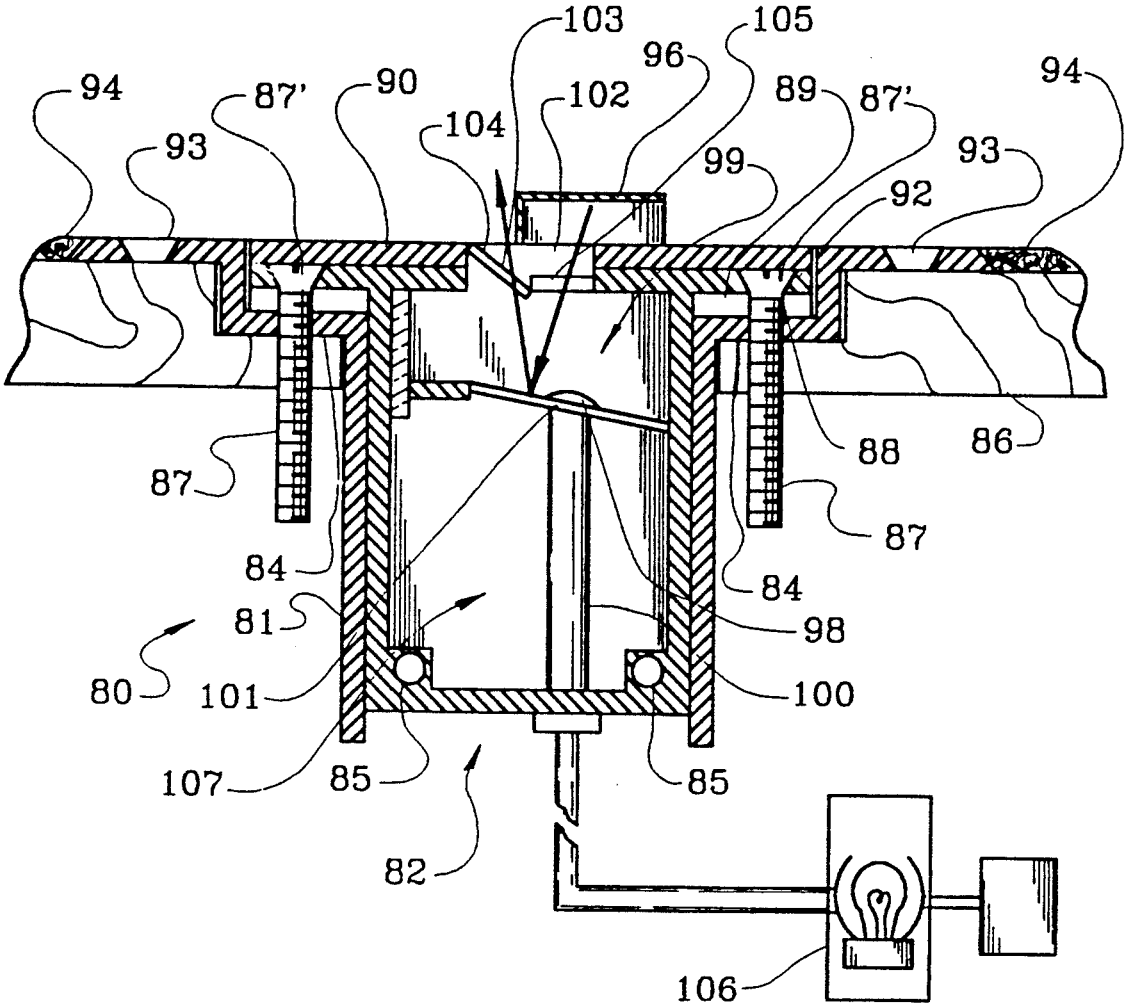
FIG. 3 shows a sectional view of a second embodiment of the instant invention mounted to a blackjack table.
Figure 4:
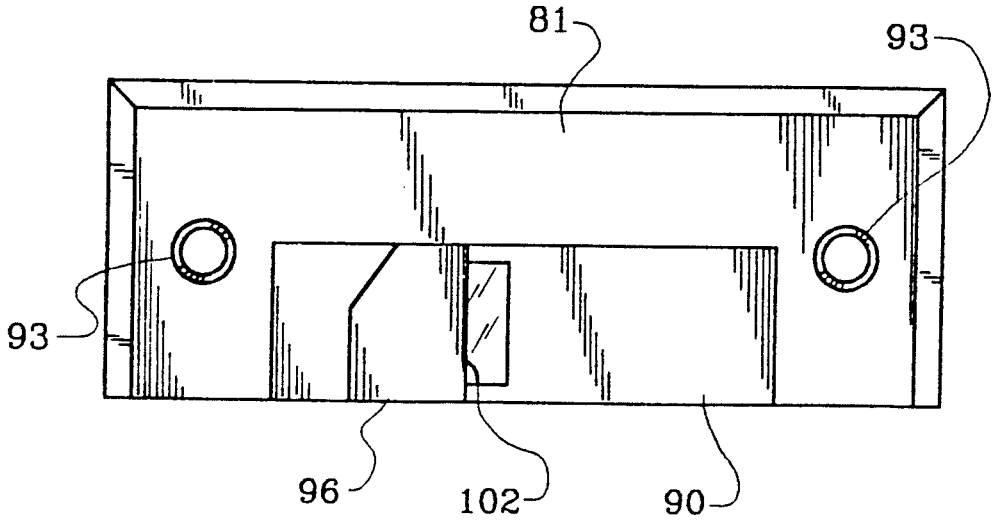
FIG. 4 shows a top plan view of the second embodiment of the instant invention.

As seen in FIG. 3, an alternative embodiment of the instant invention generally designated by the reference numeral 80 is shown. A housing generally designated by the reference numeral 82 is adapted to be connected in recess 84 of a case 81 by conventional attachment means, such as threaded bolts 87 passed through apertures 88 of recess 84. Case 81 is adapted to be connected to a conventional blackjack table 86 by conventional attachment means (not shown), such as by countersunk screws (not shown) passed through apertures 93 defined by the horizontal upper surface of case 81. Housing 82 is comprised generally of a hollow rectangular portion integrally connected to an upper planar portion 89. The upper planar portion 89 is adapted to receive a top surface panel 90. Top surface 90 is connected to upper planar portion 89 in coplanar association. A card receiving means 96 is connected to top surface 90.

As it is preferred that the top surface 90 form a smooth surface so as not to mar any of the playing cards which will come into contact therewith, the connection of the top surface 90 to upper planar portion 89 should be concealed. To this end, the threaded bolts 87 are passed through apertures 92 in upper planar portion 89 and downwardly through corresponding apertures 88 defined by recess 84 of case 81. Top surface 90 may then be laminated to upper planar portion 89 to conceal the heads 87' of bolts 87. The instant invention 80 disclosed herein is intended to fit in generally coplanar arrangement with the covering material 94 of conventional blackjack table 86.

Figure 5:
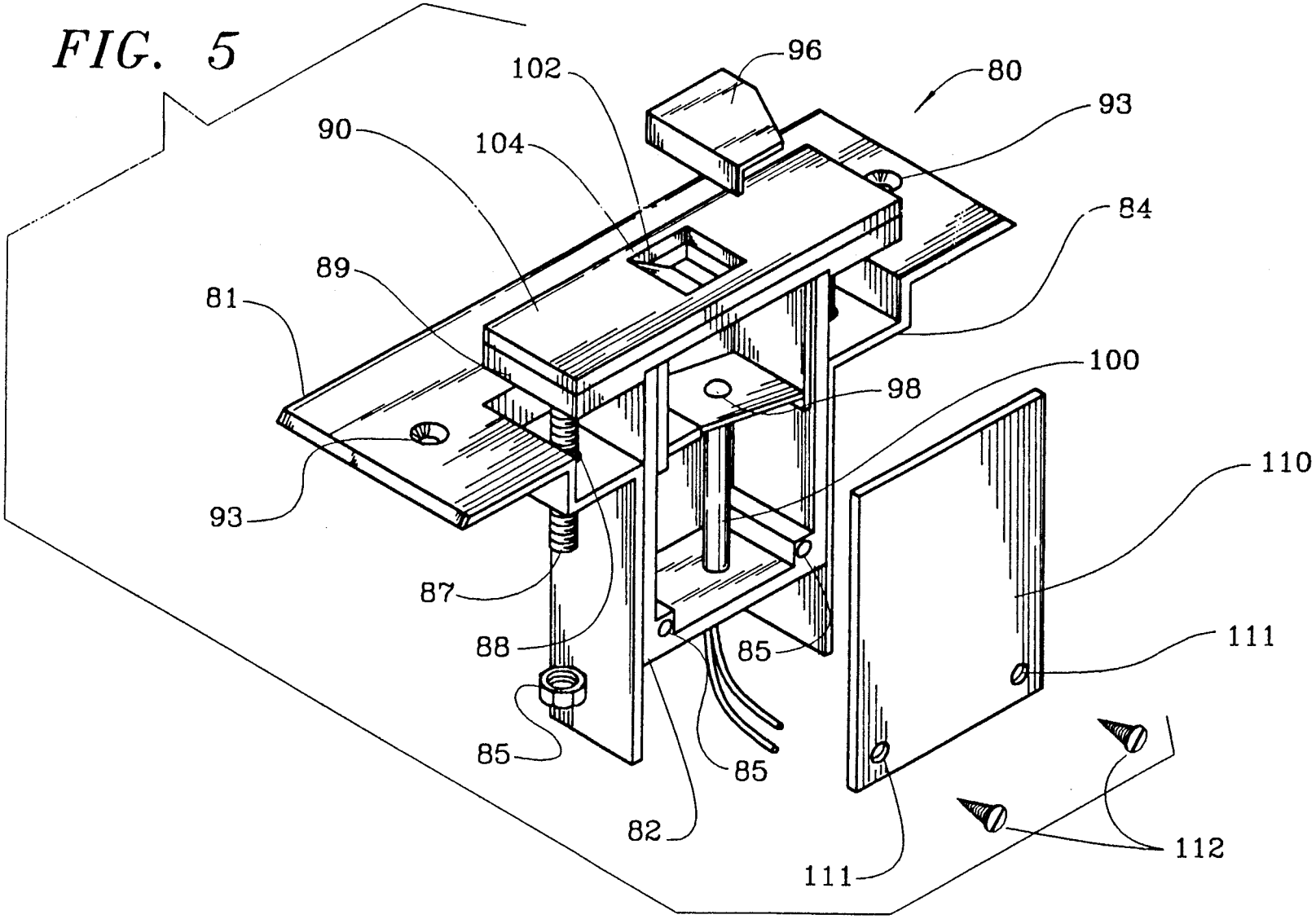
FIG. 5 shows a perspective exploded view of the second embodiment of the instant invention.

As seen in FIG. 3, an aperture 102 is defined by top surface 90 and upper planar portion 89. A card receiving device 96 is connected to top surface 90. Card receiving device 96 is positioned on top surface 90, to allow the face side of the corner being inserted into card receiving device 96 to be placed over a portion of aperture 102. As seen in FIG. 5, the card receiving means 96 is a hood-like member. However, card receiving means 96 is not limited to a hood and can be of any device which will position the face side of the inserted corner over a portion of aperture 102. The hood can have two vertical side walls.

A means for reading a portion of a playing card in the form of a card reading device generally designated by the reference numeral 99 is seen in FIG. 3. Card reading device 99 is comprised of a first, angled transparent segment 103, a second horizontal transparent segment 105 and a reflective surface 101. Preferably reflective surface 101 will be a mirror, however, any surface which will reflect the image in the corner of the playing card inserted can be utilized. The angle in first segment 103 results in a reduced glare off of the outwardly facing surface thereof, enhancing the reader's readability of the reflected image of the corner of the playing card being read. However, segments 103 and 105 may be joined as a one-piece coplanar window member if desired without departing from the scope and spirit of the invention.

In order to produce the reflecting image, reflective surface 101 is disposed below first angled segment 103 and second horizontal segment 105 and supported in position such that when a corner of the down card is inserted under card receiving device 96 and thereby over aperture 102, any indicia thereon will be reflected off of reflective surface 101 and through first angled segment 103. Thus, if the dealer's up card has a value of ten, he visually can determine whether the down card is an Ace or other than an Ace. Alternatively, the dealer can determine whether or not his down card has a value of ten or not, if his up card is an Ace.

To assist the dealer in reading the card under consideration clearly and easily, a light source generally designated by the reference numeral 107 is provided. As seen in FIG. 3, light source 107 may be comprised of fiber optic light lens 98 and conduit 100. Conduit 100 may be comprised of a bundle of fibers (not shown) or a single fiber as known in the art. Conduit 100 extends through an aperture in the bottom of housing 82. Conduit 100 extends through an aperture in reflective surface 101 and is connected to fiber optic light lens 98 at one end. The other end of conduit 100 extending through the aperture in the bottom of housing 82 will receive light transmission from any ordinary lighting device, such as light bulb 106. The light is transmitted through conduit 100 to fiber optic light lens 98. Thus, the card reading area 99 will be illuminated and the dealer can more easily and clearly determine if his down card is the card he desires. A single light bulb 106 can be used for each blackjack table 86. Alternatively, conduit 100 of the instant invention 80, for each blackjack table in the casino, may be connected to a single light bulb. Thus, a single light bulb may be used to illuminate the card reading area 99 of each card reader 80 for an entire casino, greatly reducing maintenance requirements.

As shown in FIG. 5, the housing 82 is preferably provided with a removable panel member 110 to allow access to the inside of housing 82. The removable panel member 116 may be secured to housing 82 by any convenient means such as screws 112.

The device is used as follows: After the initial deal of a hand of blackjack, the dealer and all players each have one face up card and one face down card before the remainder of the hand is dealt to the players. If the dealer's face up card is an Ace or has a value of ten, it is desirous to ascertain the value of the dealer's down card before the remainder of the hand is dealt to the players. If his face up card has a value of ten and the dealer's down card is an Ace, the hand can be called because the house wins, and no further time need transpire before a new hand is dealt. To ascertain whether or not the dealer's down card is an Ace, it is placed face down on top surface 90 and either the upper right hand corner 51 or the lower left hand corner 52 of the card, when viewed from the perspective of the playing face of the card, is inserted into card reading means 96. Due to the position of card receiving means 96 on top surface 90, the inserted corner will be placed over a portion of aperture 102. Light source 107 will illuminate card reading area 99, thus enabling the dealer to inspect the underside of the corner of the down card being read for a marking or indicia as the corner of the down card inserted in the card receiving device 96 is reflected off of reflective surface 101. If no marking or indicia is shown, the card is other than an Ace and the hand continues. If the inserted corner shows a marking or other indicia, the dealer immediately knows that the down card is an Ace and that the dealer has twenty-one, at which time the hand can be terminated.

Alternatively, if the dealer's face up card is an Ace and his down card has a value of ten, the hand can be called because the house wins, and no further time need be wasted. To ascertain whether or not the dealer's down card has a value of ten, the dealer's down card will be inserted into card receiving device 96 in a similar manner as described above for determining if the down card is an Ace. However when ascertaining whether the down card has a value of ten, either upper left hand corner 50 or lower right hand corner 53, instead of corner 51 or 52, when viewed from the perspective of the playing face of the card, will be inserted into card receiving device 96. As described above, the dealer will then ascertain whether his down card has a value of ten. If no marking or indicia is shown, the card is other than a ten value card and the hand continues. If the inserted corner shows a marking or other indicia, the dealer immediately knows that the down card has a value of ten and that the dealer has twenty-one, at which time the hand can be terminated.

Figure 7:
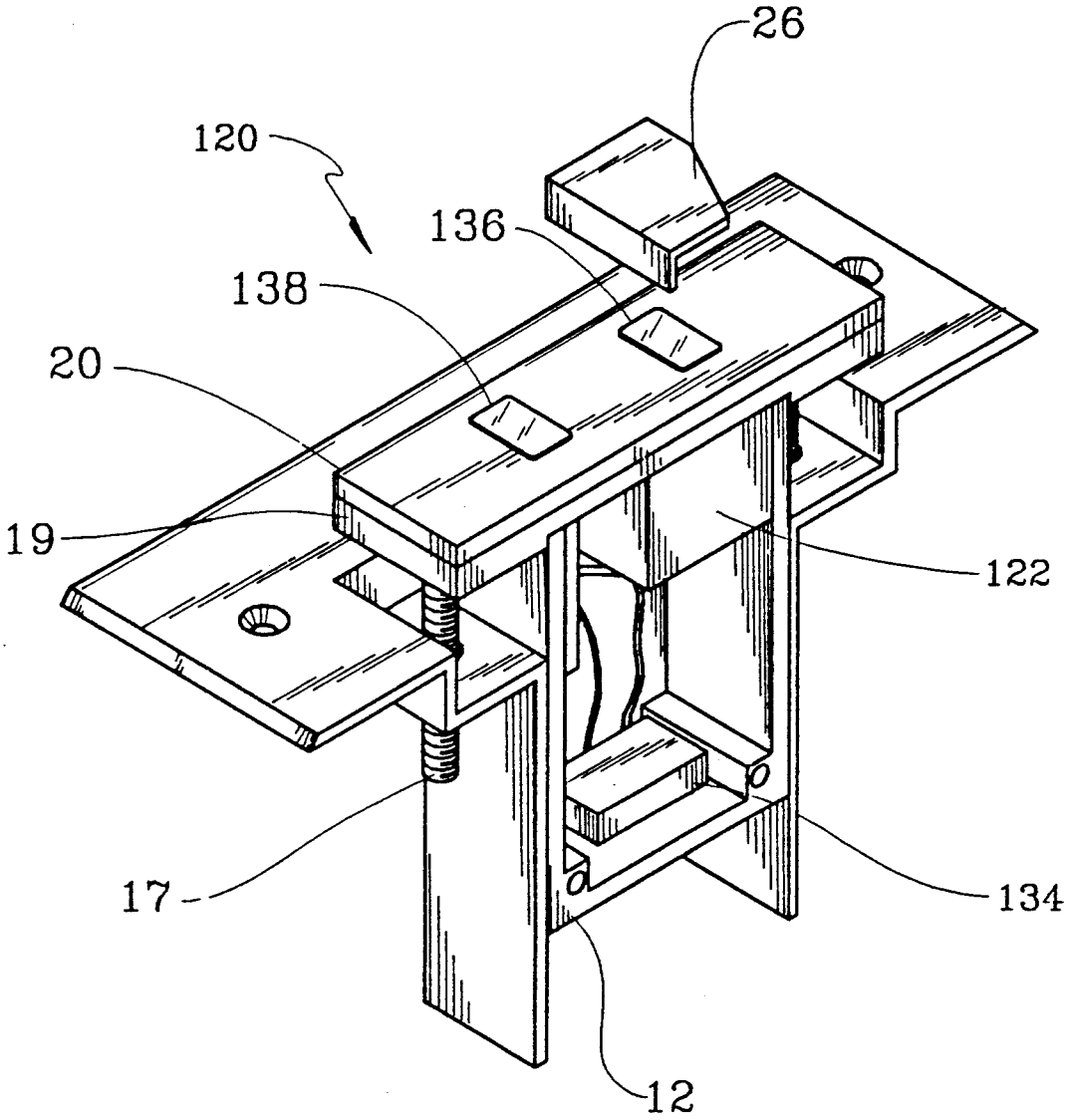
FIG. 7 shows a perspective exploded view of the third and final embodiment of the instant invention.

The final embodiment of the instant invention is shown in FIG. 7 and generally designated by the reference numeral 120. The specialized playing card is inserted into card reading device 26 causing the corner to be read to be placed over aperture 136. However, a camera unit 122 is utilized to transfer an image of the corner inserted into card receiving device 26. The image will then be transferred to a video monitor 138 for reading by the dealer. An energy source 134 will supply power to camera unit 122 and video monitor 138. Though energy source 134 is shown within housing 12, it is to be understood that energy source 134 can be external to housing 12.

The instant invention has been shown and described herein in what is considered to be the most practical and preferred embodiment. While there has been described above the principles of this invention in connection with the specific apparatus, it is to be clearly understood that this description is made only by way of example and not as a limitation to the scope of the invention. It is recognized, however, that departures may be made therefrom within the scope of the invention and that obvious modifications will occur to a person skilled in the art.

What I claim is:

1. A device for reading a mark placed on selected cards of a deck of specialized playing cards in a game of blackjack to indicate to a dealer that the dealer has been dealt "21", comprising:

(a) a housing having a means for receiving a playing card when such card is disposed face down in a blackjack table;

(b) means for reading a mark on the card while the card is disposed adjacent said means for receiving; and (c) means for indicating when the dealer has been dealt "21", said indicating means being connected to said means for reading.

2. The device of claim 1, wherein said means for receiving is a hood.

3. The device of claim 1, wherein said means for reading includes a sensor located within said housing and adapted to read the mark and, if the mark is present, to provide an output to send to said means for indicating.

4. The device of claim 3, wherein said sensor is a magnetic sensor.

5. The device of claim 3, wherein said sensor is an optic sensor.

6. The device of claim 1, wherein said means for reading includes:

(a) an electronic bar code reader located within said housing; and, (b) a means for decoding cooperating with said electronic bar code reader.

7. The device of claim 1, wherein said means for indicating comprises a light means.

8. The device of claim 1, wherein said means for reading is connected to the blackjack table in coplanar fashion.

9. A device for reading a portion of a specialized playing card in a game of blackjack to indicate to a dealer that the dealer has been dealt a blackjack pair, comprising:

a housing means having an upper member, said upper member defining a top surface and a card reading aperture;

means for reading a portion of a specialized playing card, said means for reading being connected to said housing means adjacent said aperture; and means operatively associated with said reading means for informing a blackjack dealer of the presence of a blackjack.

10. The device of claim 9, further comprising a means for receiving the portion of the specialized card to be read, said means for receiving being connected to said upper member.

11. The device of claim 10, wherein said means for reading comprises:

a means for reflecting an image of the portion of the specialized playing card through said card reading aperture when the specialized playing card is held against said means for receiving.

12. The device of claim 11, wherein said means for reading further comprises a means for illuminating the portion of the specialized playing card.

13. The device of claim 12, wherein said means for illuminating includes a lamp.

14. The device of claim 11, wherein said means for reflecting is a mirror.

15. The device of claim 9, wherein said means for reading is connected to a blackjack table in coplanar fashion.

16. A method of using a card reading device for increasing the speed of play of a game of blackjack in a fair and secure manner, said card reading device being categorized as having a means for reading a portion of a specialized playing card while said playing card is disposed face down on said device, means for receiving said portion of said specialized playing card to be read, said means for receiving adapted to align said face down card with said means for reading; comprising the steps of:

dealing a hand of blackjack to a plurality of players, including the dealer;

ascertaining whether the dealer's down card is an Ace if the dealer's up card has a value of ten, and if said down card is an Ace, terminating the hand, or, alternatively, if said down card is other than an Ace, continuing to play;

ascertaining whether the dealer's down card has a value of ten if the dealer's up card is an Ace, and if said down card has a value of ten terminating the hand, or, alternatively, if said down card does not have a value of ten, continuing to play;

wherein the step of ascertaining whether the dealer's down card is an Ace is carried out using said card reading device to read a portion of said specialized playing card.

17. A device for sensing specialized indicia from a downwardly facing card on a playing table during the game of blackjack to determine if a dealer has been dealt "21", comprising:

means for receiving a portion of a playing card having specialized indicia, the playing card being downwardly facing;

means for sensing the presence of the specialized indicia; and means for informing the dealer when the dealer has been dealt "21" operatively associated with said means for sensing.

18. A device for reading a portion of each card of a deck of specialized playing cards in a game of blackjack to determine when a dealer has been dealt "21", comprising:

(a) a deck of specialized playing card;

(b) a housing having a top planar member defining a top planar surface;

(c) means for reading a portion of each of said specialized playing cards while each said specialized playing card is disposed face down on a blackjack table and on said top planar surface; and (d) indicating means operatively associated with said reading means for indicating when the dealer has been dealt "21".

19. The device of claim 18, further comprising means for receiving a corner of each of said specialized playing cards, said means for receiving being connected to said top planar surface.

20. The device of claim 19, wherein said means for receiving is a hood attached to said top planar surface having at least two vertical side walls and a top.

21. The device of claim 18, further comprising a case defining a recess, said housing being removably attached to said case within said recess.

22. The device of claim 18, wherein all Ace cards of said specialized playing cards have first specialized indicia means at the upper right and lower left opposite diagonal corners thereof.

23. The device of claim 22, wherein all ten value cards of said specialized playing cards have second specialized indicia means at the upper left and lower left right opposite diagonal corners thereof.

24. The device of claim 18, wherein said means for reading comprises an optic sensor electrically connected to said means for indicating and a power source.

25. The device of claim 23, wherein said means for reading is a magnetic sensor and said first and second specialized indicia means is comprised of a ferromagnetic material.

26. The device of claim 18, wherein all Ace cards of said specialized playing cards have first bar code means at opposite diagonal corners thereof.

27. The device of claim 26, wherein all ten value cards of said specialized playing cards have second bar code means at opposite diagonal corners thereof.

28. The device of claim 27, wherein said means for reading comprises a means for reading bar code.

29. The device of claim 18, wherein said means for indicating is a light means connected to a power source, said light means being energized when said means for reading senses that the specialized playing card being read is of a desired value, indicating that the blackjack dealer has "21."

30. A device for reading a portion of a specialized playing card in a game of blackjack to indicate to a dealer that the dealer has been dealt "21," comprising:

a housing, said housing including an upper member defining an upper surface and an aperture;

a means for reading a portion of a specialized playing card when the portion is positioned in registry with said aperture; and means for indicating when the dealer has been dealt "21."

31. The device of claim 30, further comprising a means for receiving the portion of the specialized playing card, said means for receiving being connected to said upper member.

32. The device of claim 30, wherein said means for reading comprises a means for reflecting the image of the portion of the specialized playing card through said aperture when the specialized playing card is held against said means for receiving.

33. The device of claim 32, further comprising a means for illuminating the portion of the specialized playing card.

* * * * *